US005938214A

United States Patent [19]

Roman et al.

[11] Patent Number: 5,938,214

[45] Date of Patent: Aug. 17, 1999

[54] SKATE WITH IN-LINE WHEELS

[75] Inventors: Maurizio Roman, Noale; Roberto Gorza, Feltre, both of Italy

[73] Assignee: Nordica S.p.A., Trevignano, Italy

[21] Appl. No.: 08/861,049

[22] Filed: May 21, 1997

[30] Foreign Application Priority Data

May 30, 1996 [IT] Italy ..... TV96A0068

[51] Int. Cl.[6] ..... A63C 17/06

[52] U.S. Cl. ..... 280/11.22; 280/11.27

[58] Field of Search ..... 280/11.22, 11.19, 280/11.2, 11.21, 11.27, 11.23, 11.24; 301/5.3

[56] References Cited

U.S. PATENT DOCUMENTS

| | | | |
|---|---|---|---|
| 1,460,183 | 6/1923 | Snyder | 301/5.3 |
| 4,666,168 | 5/1987 | Hamill et al. . | |
| 4,666,169 | 5/1987 | Hamill et al. | 280/11.23 |
| 4,909,523 | 3/1990 | Olson | 280/11.22 |
| 5,069,462 | 12/1991 | Murga | 280/23 |
| 5,092,614 | 3/1992 | Malewicz | 280/11.22 |
| 5,303,940 | 4/1994 | Brandher . | |
| 5,346,231 | 9/1994 | Ho | 280/11.2 |
| 5,374,072 | 12/1994 | Landers | 280/11.27 |
| 5,566,957 | 10/1996 | Ho | 280/11.22 |
| 5,575,489 | 11/1996 | Oyen et al. | 280/11.22 |
| 5,630,598 | 5/1997 | Zorzi et al. | 280/11.28 |
| 5,685,550 | 11/1997 | Mayer, II | 280/11.2 |

FOREIGN PATENT DOCUMENTS

| | | | |
|---|---|---|---|
| 0608576 | 8/1994 | European Pat. Off. . | |
| 2679781 | 2/1993 | France . | |
| 29518529 | 4/1996 | Germany . | |
| 35107 | 4/1912 | Sweden | 280/11.2 |

*Primary Examiner*—D. Glenn Dayoan
*Assistant Examiner*—Jason Morrow
*Attorney, Agent, or Firm*—Guido Modiano; Albert Josif

[57] ABSTRACT

An in-line skate having a shoe connected with a frame having lateral wing pairs rotatably supporting wide tread in-line wheels structured such that when the skate is supported on a planar support surface and the skate is tilted from a vertical position in an inner direction an inner maximum laterally protruding point of an inner lateral surface of the skate shoe will make contact with the planar support surface before contact will be made with the planar support surface by the inner lateral wings, and such that when the skate is supported on the planar support surface and the skate is tilted from a vertical position in an outer direction an outer maximum laterally protruding point of an outer lateral surface of the shoe will make contact with the planar support surface before contact will be made with the planar support surface by the outer lateral wings.

7 Claims, 4 Drawing Sheets

SKATE WITH IN-LINE WHEELS

BACKGROUND OF THE INVENTION

The present invention relates to a skate with in-line wheels.

In-line skates are generally constituted by a shoe comprising a shell, made for example of plastics, with which a plastic cuff is rotatably associated; a soft innerboot is inserted in the shell and cuff. Fastening means, such as adapted conventional levers, are associated with the shell and cuff.

A frame shaped substantially like an inverted U is associated below the shell and a plurality of wheels are pivoted, so as to rotate freely by means of pivots, between the wings of the frame and are thus arranged in line.

A drawback which can be observed in these conventional skates is the fact that the dimensions and position of the wings of the frame considerably affect the behavior of the skate during sports practice, particularly when skating along a curve or bend.

In this condition the user can in fact set a lateral inclination angle which is at the maximum value when it corresponds to the angle between the plane whereon the wheel rolls and the plane passing through the lowest point of the frame wing and the lateral surface of the wheel.

This lateral inclination angle is therefore limited by the fact that the wings constituting the frame and between which the wheels are pivoted set a limit which cannot be exceeded, on penalty of slipping and falling violently, consequently limiting the turning radius and therefore the maneuverability of the skate.

U.S. Pat. No. 4,666,168 discloses a skate having just two wheels and comprising a shell below which a frame is associated, the frame is formed by two separate half-shells which can be associated to each other by screws.

Splined profiles are provided below the shell for connection to the frame, and screws for fixing the half-shells are located at adapted reference planes which rest against each other upon fastening.

The position of the reference planes, which are adapted to ensure good connection between the half-shells, and of the corresponding fastening screws prevents the use of wheels in the central region, thus limiting the skate maneuverability, directionality and stability; moreover, the lateral bulk of the supporting arms of the pivot and of the wheels limits the inclination which can be achieved with the skate.

U.S. Pat. No. 5,348,321 discloses a skate with in-line wheels in which the frame has a single wing from which wheel pivots protrude in a cantilever manner; in this case, too, the dimensions of the wing limit the inclination of the skate, and it is also noted that the moment per unit of surface discharged at the root of the pivot is very high because of the length of the pivot and because of its cross-section, which seems to be small.

SUMMARY OF THE INVENTION

An aim of the present invention is therefore to solve the described problems, eliminating the drawbacks of the cited prior art. A further aim of the invention is to provide a skate with in-line wheels which allows the user to lean the skate laterally by a greater angle than the angle possible with the prior art.

An object of the present invention is to provide a skate which allows to user to make very tight turns or to perform effective sideslip braking.

A further object of the present invention is to provide a skate which is reliable and safe in use, allowing the user to maintain excellent directionality even in case of very tight turns and of sideslip braking actions.

Another object of the present invention is to provide a skate having low manufacturing costs and which can be obtained with conventional machines and equipment.

This aim, these objects, and others which will become apparent hereinafter are achieved by a skate with in-line wheels, comprising a shoe and a frame which is provided with wings having a plurality of in-line wheels pivoted thereto, characterized in that said wings of said frame are contained in a space between a first median plane lying longitudinally to said frame and a second plane which is tangent to the lateral surfaces of said shoes and wheels.

BRIEF DESCRIPTION OF THE DRAWINGS

Further characteristics and advantages of the present invention will become apparent from the following detailed descriptions of three embodiments thereof, illustrated only by way of non-limitative example in the accompanying drawings, wherein.

DESCRIPTION OF THE PREFERRED EMBODIMENTS

Figure 2:
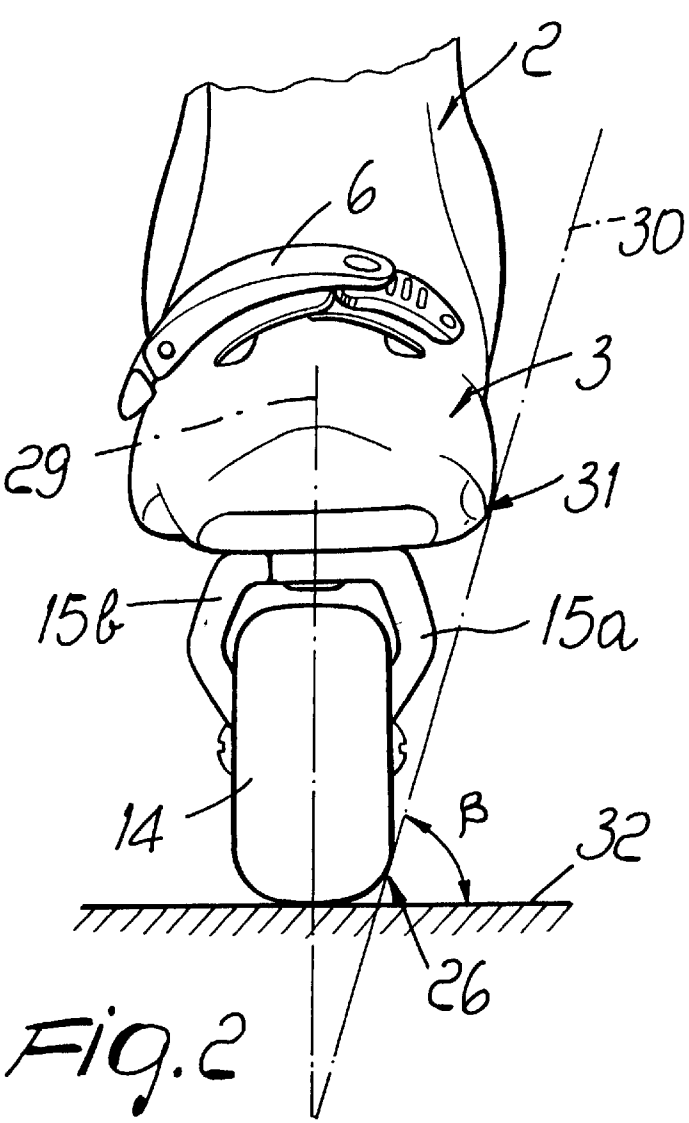
FIG. 2 is a front view of the skate of FIG. 1.
Figure 1:
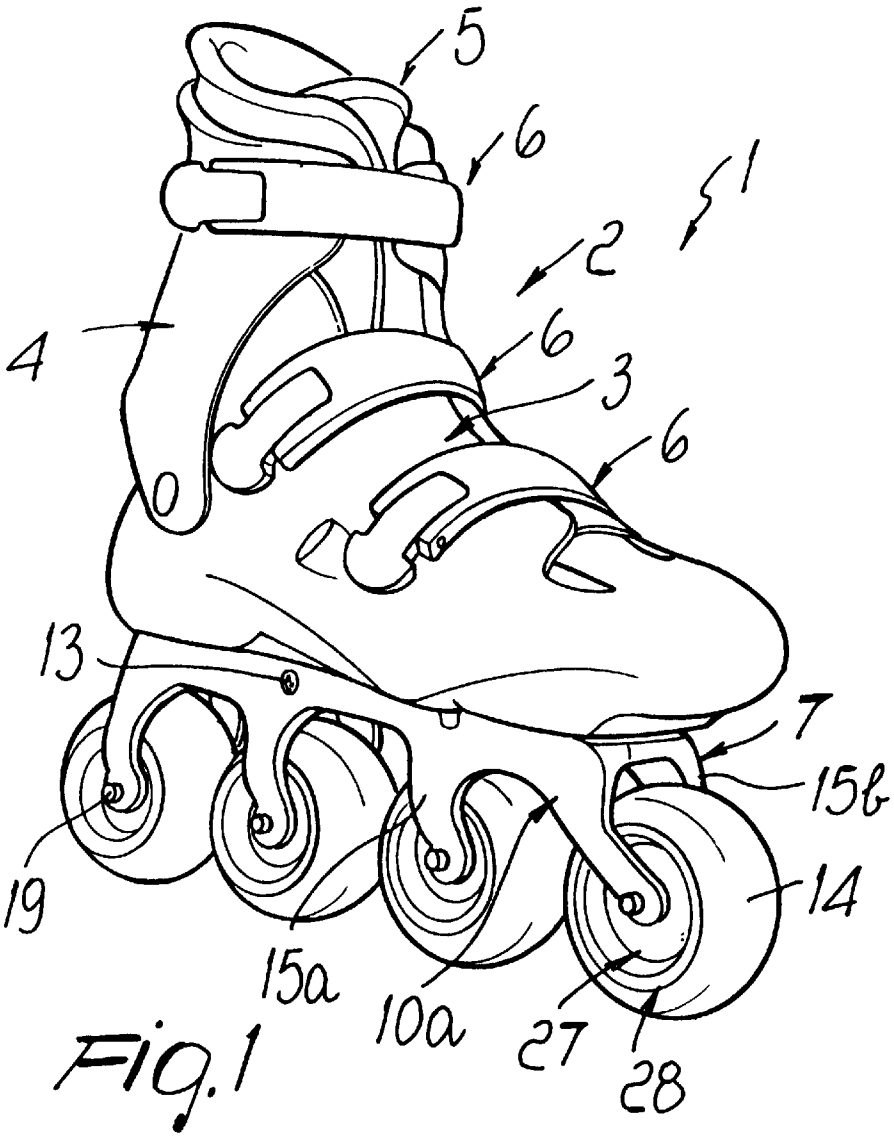
FIG. 1 is a lateral perspective view of a skate.

With reference to the above figures, the reference numeral 1 designates a skate comprising a shoe 2 constituted by a shell 3 whereto a quarter 4 is articulated; a soft innerboot 5 is inserted in the shell and quarter, and adapted tensioning means, such as levers 6, are provided for fastening the shell and the quarter.

Figure 7:
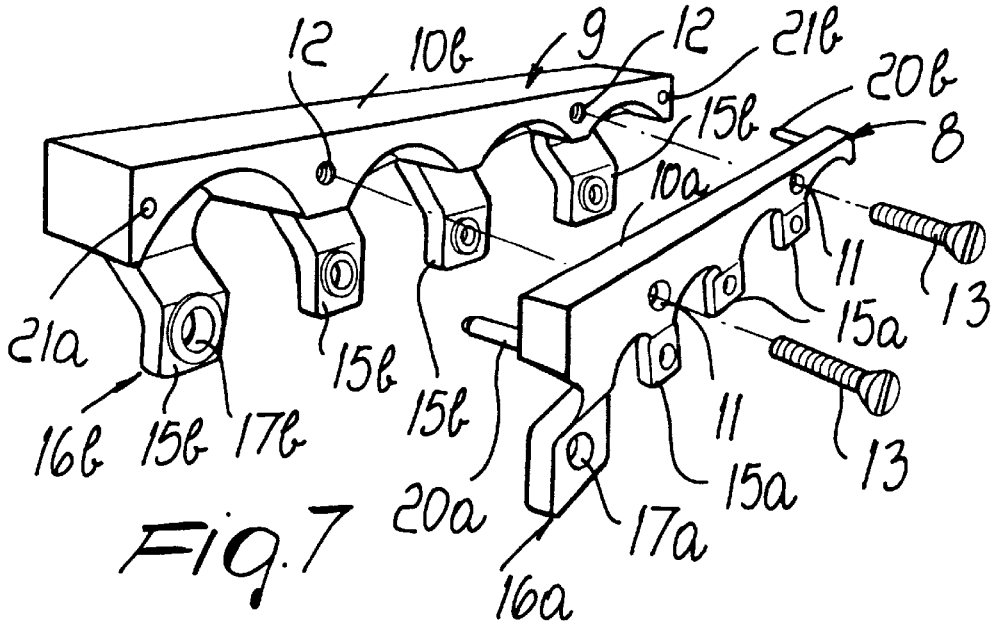
FIG. 7 is an exploded view of the frame.

A frame 7 is associated below the shell 3 and, as shown in FIG. 7, is advantageously constituted by a first half-shell 8 and by a second half-shell 9; each half-shell is constituted by a bar, designated by the reference numerals 10*a* and 10*b*, having adapted first transverse through holes 11 and second internally threaded partial transverse holes 12 for interconnecting the first and the second half-shells by means of adapted first screws 13.

The bars 10*a* and 10*b* also have a shaped lower surface for partially accommodating a plurality of wheels 14.

A plurality of separate wings 15*a*, 15*b* protrude laterally and below each bar 10*a* and 10*b* and are approximately S-shaped; their free ends 16*a*, 16*b* are arranged on planes which are approximately perpendicular to the bars 10*a* and 10*b*, are parallel to each other, and have an axial spacing which is smaller than the maximum width of the wheels 14 once the frame 7 has been assembled.

Adapted third holes 17*a*, 17*b* are also formed at the free ends 16*a* and 16*b* for the insertion of adapted pivots 18 which can be fastened by second screws 19 for pivoting the wheels 14.

In order to allow optimum interconnection between the first and the second half-shells, there are provided pins 20*a*, 20*b* which protrude at right angles at the ends for example of the bar 10*a* and can be arranged at adapted and complementarily shaped first seats 21*a*, 21*b* formed on the other bar 10*b*.

Each wheel 14 is substantially constituted by a hub 22 wherewith two bearings 24*a* and 24*b* are associated through the interposition of an adapted spacer 23, a tread 25 being associated with the hub 22, for example by molding plastics.

Figure 3:
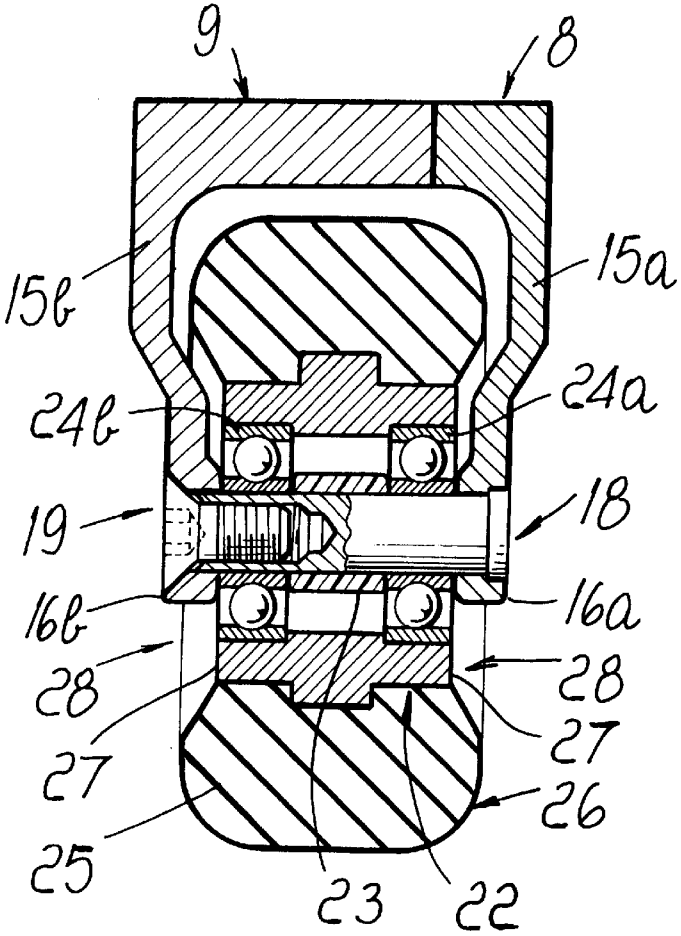
FIG. 3 is a transverse sectional view of the frame with a wheel associated therewith.

The tread has a lateral surface 26 which can be arranged at the same plane of arrangement as the lateral surface 27 of the hub or even protrude beyond it, as shown in FIG. 3.

A concave region 28 is thus formed between the lateral surface 26 of the tread 25 and the lateral surface 27 of the hub 22, the free ends 16*a*, 16*b* of the wings 15*a*, 15*b* being arranged adjacent to the lateral surface of the hub 22.

Use of a wheel 14 having a significantly wide tread allows better stability by increasing the ground contact surface.

The wings 15*a*, 15*b* of the frame 7 are also contained in the space between a first median plane 29 lying longitudinally to the frame 7 and a second plane 30 which is tangent to the lateral surface 26 of the wheels 14 and to the lateral surface 31 of the shell 3.

The particular configuration assumed by the wings 15*a*, 15*b* of the frame 7 therefore allows to form, between the contact plane 32 of the tread 25 of the wheel 14 and the second plane 30 which is tangent to the lateral surfaces 26 of the wheel or 31 of the shell, an angle β which is larger than the angle achievable by skates according to the cited prior art.

Figure 4:
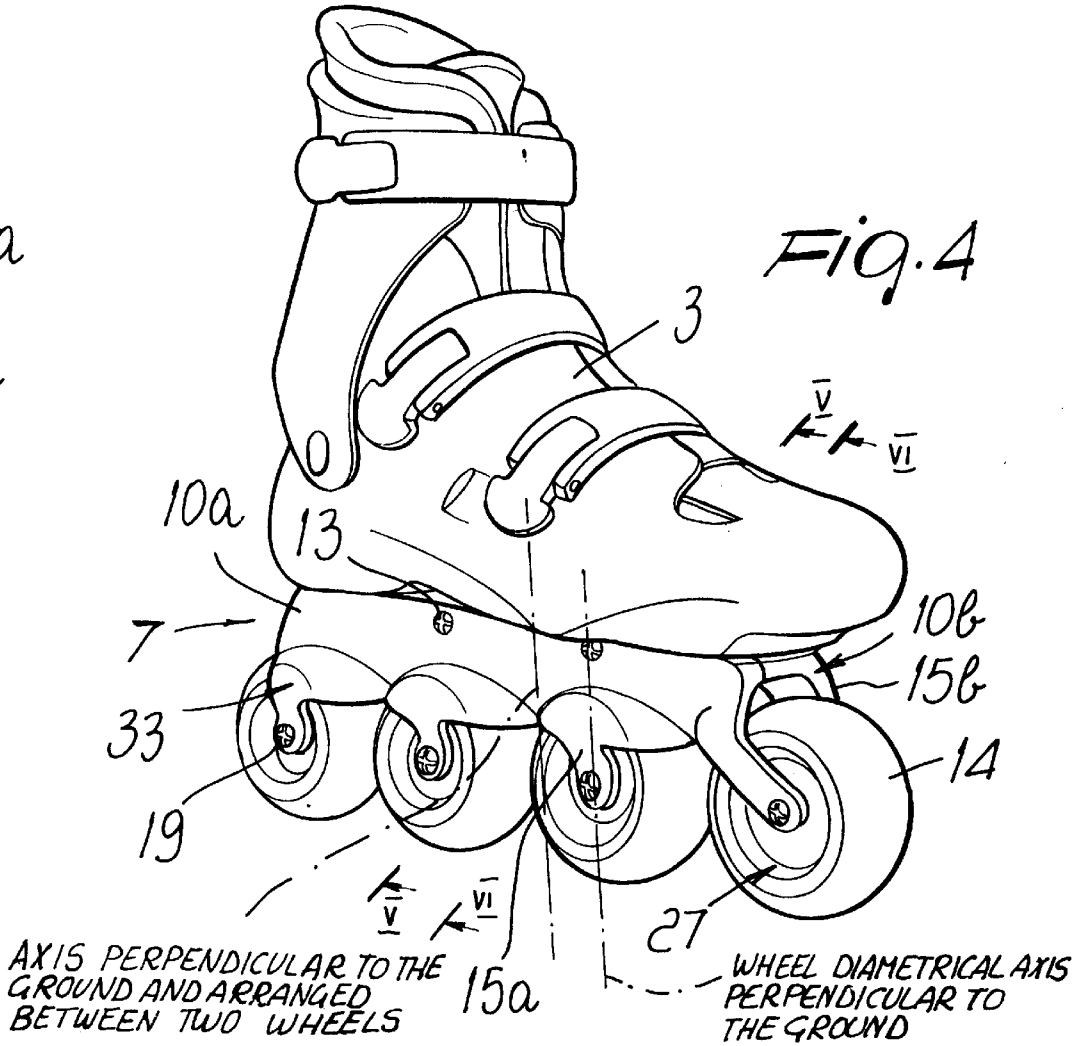
FIG. 4 is a view, similar to FIG. 1, of the skate in which the frame allows to wrap around the upper part of the wheels.
Figure 6:
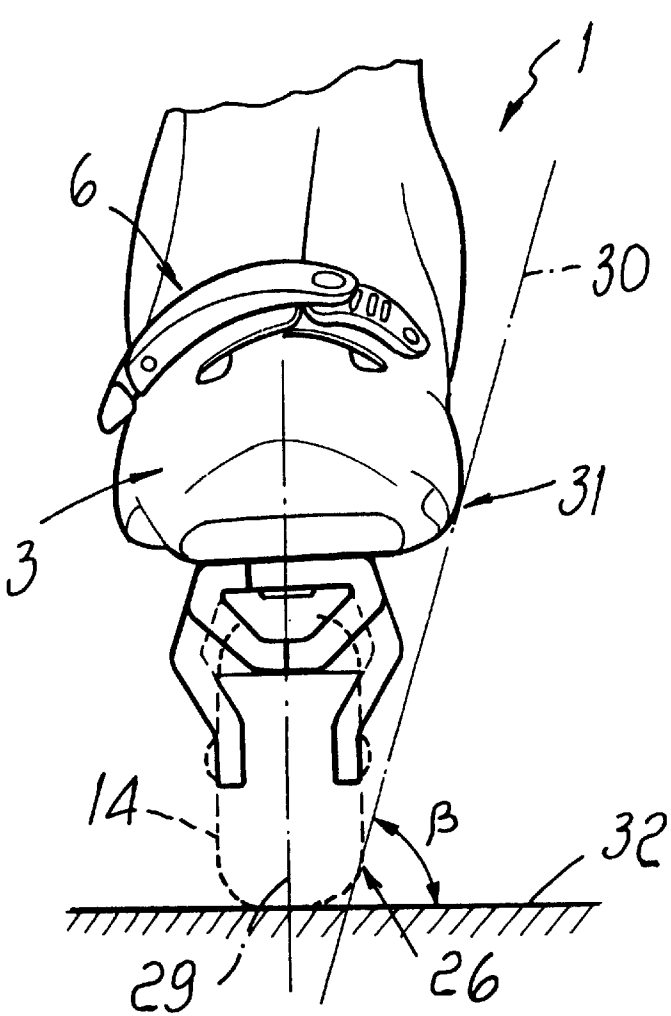
FIG. 6 is a sectional view, taken along the plane VI—VI of FIG. 4.
Figure 5:
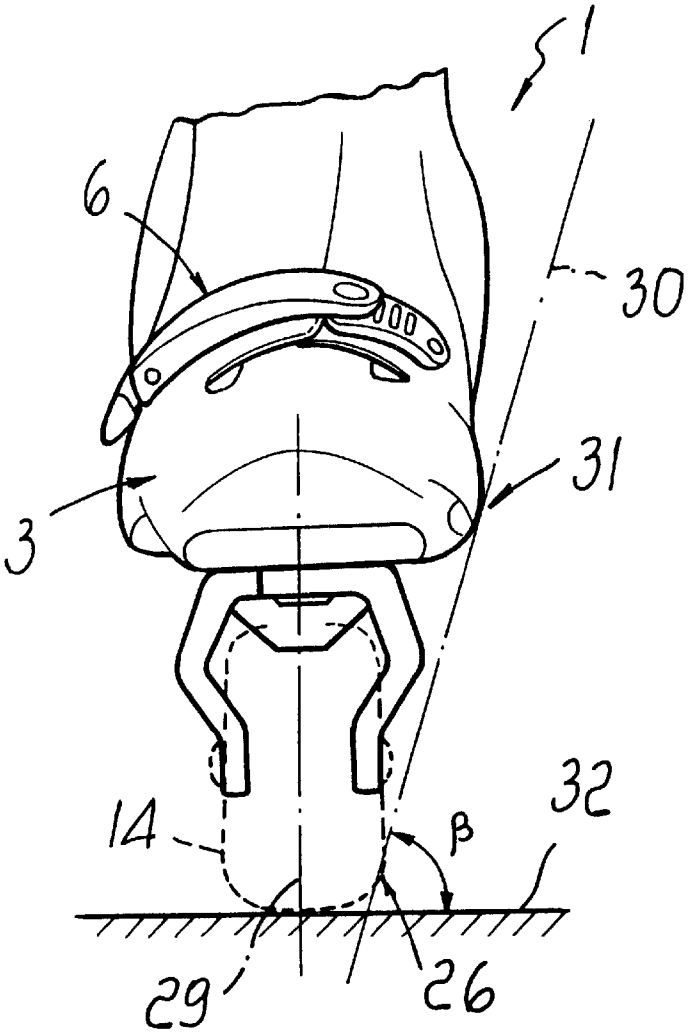
FIG. 5 is a sectional view, taken along the plane V—V of FIG. 4.

Advantageously, the frame 7 can have, at one or more wheels, as shown in FIG. 4, a configuration which surrounds the upper part of the wheels, as shown in the details of FIG. 6, wherein a fairing 33, blended with the wings 15*a* and 15*b*, protrudes from the bars 10*a* and 10*b*.

It has thus been shown that the present invention has achieved the intended aim and objects, a skate having been provided which can be inclined laterally by a greater angle than a conventional skate by means of the particular configuration of the frame wings. In fact an excessive lean of the skate would cause the shell 3 to touch the ground, rather than the frame wings, entailing perhaps damage to the shell but not slipping, as would occur if the frame wings touched the ground.

The possibility to tilt the skate by a greater angle than achieved by the prior art allows the athlete to improve the performances, such as for example very tight turns or more effective sideslip braking.

The presence of three or more wheels also allows easier and simpler execution of the invention, since the larger number of wheels decreases the force that acts on the wings 15*a*, 15*b* of each wheel, allowing to reduce the dimensions of the wing.

Moreover, from the point of view of use, a skate having three or more wheels combined with the illustrated embodiment allows to achieve maximum effectiveness as regards maneuverability, since the presence of optionally two central wheels allows to "pivot" during turning, in that the central wheels could be spaced from the frame more than the wheels located at the end of said frame and could thus facilitate turning.

The in-line skate according to the invention is susceptible of numerous modifications and variations, all within the scope of the appended claims.

Figure 8:
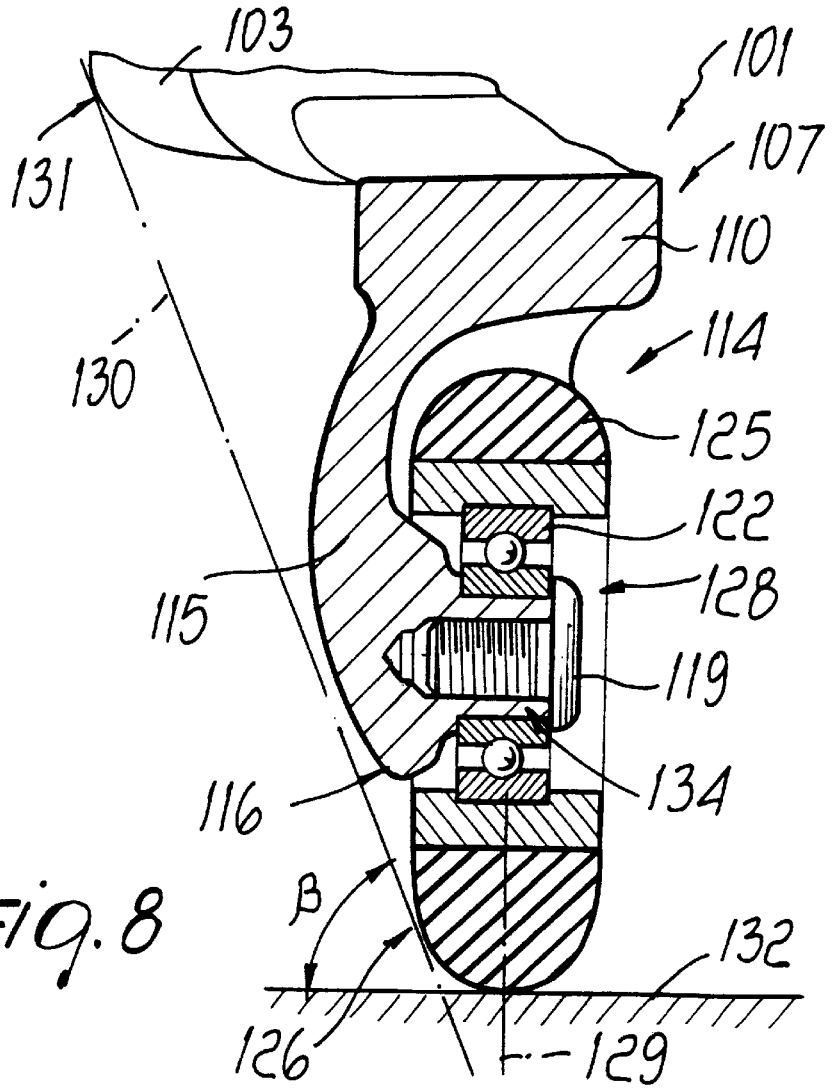
FIG. 8 is a partially transversely sectional view of a different embodiment of the frame.

Thus, for example, FIG. 8 illustrates a skate 101 which comprises a frame 107 constituted by a single bar 110 from which a plurality of wings 115 protrude laterally at a single side or alternately at one side or the other.

The wings 115 have a shaft 134 at the free end 116. The hub 122 of a wheel 114 is associable with the shaft 134 and a threaded seat is formed axially on the shaft for a second screw 119 for locking said hub.

A tread 125 which is as wide as, or wider than, said hub so as to form a concave region or a recess 128, as shown in FIG. 8, is also associable with said hub.

In this case, too, the wing 115 acts in the space formed between the first median plane 129 lying longitudinally to the frame 107 and the second plane 130 which is tangent to the lateral surface 126 of the wheel 114 and to the lateral surface 131 of the shell 103.

In the illustrated embodiment, in addition to achieving the above-described advantages, the moment per unit of surface that acts on the shaft 134, which is arranged approximately parallel to the contact plane 132 of the wheel 114, is smaller than in the cited prior art, both because of the shorter length of said shaft and because of the larger cross-section which can be provided at its root for connection to the wing 115, which is the region where the moment reaches its maximum value.

The materials and the dimensions constituting the individual components of the skate may of course be the most pertinent according to specific requirements.

What is claimed is:

1. A skate with in-line wheels, comprising:

a shoe having a pair of oppositely arranged lateral surfaces;

a plurality of in-line wheels each of which has a significantly wide tread for rolling contact with a support surface wherein the tread has a generally flat continuous horizontal central portion for the rolling contact with the support surface;

a frame connected to said shoe and extending downwardly from said shoe and provided with wings having said plurality of in-line wheels pivoted thereto such that an inner tangent plane is defined which is tangent to an inner maximum laterally protruding point of an inner one of said lateral surfaces of said shoe and to an inner maximum laterally protruding point of said plurality of said in-line wheels, and further such that an outer tangent plane is defined which is tangent to an outer maximum laterally protruding point of an outer one of said lateral surfaces of said shoe and to an outer maximum laterally protruding point of said plurality of said in-line wheels, and for each of said wheels said wings comprising an inner lateral wing connected to an inner lateral side of said each of said wheels and an outer lateral wing connected to an outer lateral side of said each of said wheels arranged opposite to said inner lateral side, each inner lateral wing and each outer lateral wing of said wings of said frame being contained in a space between said inner tangent plane and said outer tangent plane such that when the skate is supported on a planar support surface and the skate is tilted from a vertical position in an inner direction said inner maximum laterally protruding point of said inner one of said lateral surfaces of said shoe will make contact with said planar support surface before contact will be made with said planar support surface by said each inner lateral wing, and such that when the skate is supported on said planar support surface and the skate is tilted from a vertical position in an outer direction said outer maximum laterally protruding point of said outer one of said lateral surfaces of said shoe will make contact with said planar support surface before contact will be made with said planar support surface by said each outer lateral wing.

2. A skate according to claim 1, wherein said shoe comprises a quarter articulated to a shell, and a soft inner-boot inserted in said shell and quarter, said frame comprising a first half-shell and a second half-shell, each of said half-shells comprising a bar a first one of which has first transverse through holes and a second one of which has second transverse internally threaded partial holes for screws for mutually connecting said half-shells, said lateral wings being connected to and protruding laterally and downward with respect to said bars, said lateral wings having respective free ends arranged on respective inner and outer planes which are parallel to each other and approximately perpendicular to said bars.

3. A skate according to claim 1, wherein each of said wheels comprises a hub having a width which is less than a maximum width of said tread so as to form a concave region, said lateral wings each having a respective free end arranged adjacent to and connected to a respective lateral surface of said hub of each of said wheels at the concave region.

4. A skate according to claim 3, wherein each said wing wraps around a respective tread and extends into the concave region of a respective wheel to be arranged at and connected to the lateral surface of the respective hub.

5. A skate according to claim 4, wherein said wings have an axial spacing which, once said frame has been assembled, is less than the maximum width of said tread.

6. A skate according to claim 1, wherein said frame has, at one or more of said wheels, a shape which wraps around an upper part of said wheels, so as to form a fairing which is blended with a respective wing.

7. A skate according to claim 5, wherein each of said wings has an approximately S-shape with a portion extending into the respective concave region of a respective wheel.

* * * * *